United States Patent [19]

Navarro

[11] 4,339,106

[45] Jul. 13, 1982

[54] REUSABLE BRACKET ASSEMBLY FOR CONCRETE FORM

[76] Inventor: Ramon Navarro, 10138 E. Rush St., El Monte, Calif. 91733

[21] Appl. No.: 174,036

[22] Filed: Jul. 31, 1980

[51] Int. Cl.[3] ..... E04G 17/04; E04G 17/06; E04G 17/12

[52] U.S. Cl. ..... 249/219 R

[58] Field of Search ..... 249/216, 217, 218, 18, 249/22, 26, 2–5, 33, 34, 44, 45, 38, 47, 189, 190, 192, 219 R, 219 W, 40, 139, 160, 163, 187, 188, 205, 207, 208, 210, 26, 27

[56] References Cited

U.S. PATENT DOCUMENTS

| | | | |
|---|---|---|---|
| 966,802 | 8/1910 | Daisley | 249/36 |
| 1,067,420 | 7/1913 | Forbis | 249/5 |
| 1,130,647 | 3/1915 | Thompson | 249/33 |
| 1,405,650 | 2/1922 | Wilson | 249/47 |
| 1,644,586 | 10/1927 | Heltzel | 249/5 |
| 2,250,839 | 7/1941 | Perry | 249/2 |
| 2,711,573 | 6/1955 | Bliss | 249/210 |
| 2,948,943 | 8/1960 | Torrelli | 249/5 |
| 3,207,465 | 9/1965 | Papin | 249/5 |
| 3,578,309 | 5/1971 | Freedman | 249/219 R |

FOREIGN PATENT DOCUMENTS

| | | | |
|---|---|---|---|
| 1950155 | 5/1970 | Fed. Rep. of Germany | 249/40 |
| 2344626 | 3/1974 | Fed. Rep. of Germany | 249/219 |
| 2311238 | 9/1974 | Fed. Rep. of Germany | 249/26 |
| 150476 | 9/1920 | United Kingdom | 249/219 |

*Primary Examiner*—Willard E. Hoag
*Attorney, Agent, or Firm*—Keith D. Beecher

[57] ABSTRACT

A reusable bracket assembly for supporting a wooden form member during the pouring of a concrete tilt-up panel on a horizontal base, and which permits a concrete column to be formed integrally on the panel. The bracket assembly comprises two plates formed of heavy metal, such as steel, and supported in spaced and parallel relationship in an upright position by adjustable telescoped elongated members. The plates have holes in them which enables them respectively to be nailed, or otherwise attached to two corresponding wooden forms on opposite sides of the column to be formed on the panel. An upright post is adjustably attached to one of the elongated members adjacent to the inner plate to support the assembly in an upright position until the poured concrete panel starts to set. Then, the post is removed, and the hole left by it in the concrete panel is filled with concrete. At that stage, the concrete panel has set sufficiently to hold the assembly upright until the panel and column have completely set. After the panel and column have completely set, the form and attached bracket assembly are removed, and the bracket assembly is then removed from the form for reuse.

3 Claims, 3 Drawing Figures

REUSABLE BRACKET ASSEMBLY FOR CONCRETE FORM

BACKGROUND

The construction of tilt-up concrete panels, a horizontal concrete slab is first constructed to form a base on which the tilt-up concrete panels are formed. A wooden form is made from wooden members which are nailed or bolted together into a rectangular configuration so as to circumscribe a rectangular area on the base. Concrete is then poured into the form. When the concrete is set, the form is removed, and the resulting concrete panel is tilted up from the base to an upright position. The base is coated with grease, or other appropriate material to prevent the panel from becoming attached to the base.

Copending Application Ser. No. 030,071 filed Apr. 16, 1979 in the name of the present inventor, discloses a heavy steel reusable bracket which can be attached to the base and nailed to the wooden form members, a number of such brackets being used around the form to brace the form members and maintain them in their upright positions.

It is often desired to form a concrete column integrally on the concrete panel when the panel is being poured, such a column extending across the panel, and being located either at the end or at an intermediate position of the panel. The formation of such a column requires two additional spaced and parallel wooden form members extending across the plane of the upper edge of the form described above, either at the end or at an intermediate position. Concrete is then poured into the form and between the additional form members. Problems have been encountered in the past in providing appropriate means for bracing and supporting the two additional form members in position, especially during the initial concrete pouring stage.

An objective of the present invention is to provide a relatively simple and inexpensive bracket assembly for solving the aforesaid problem, and which provides a simple and efficient means for bracing and supporting the additional form members as the concrete panel and column are being poured.

A feature of the bracket assembly of the invention, in addition to its reusability, is the fact that it can be quickly set up and attached to the additional wooden frame members, and quickly removed at the end of the operation, with the entire set up and breakdown of the form and bracket assemblies capable of being performed by a single worker.

DETAILED DESCRIPTION OF THE ILLUSTRATED EMBODIMENTS

Figure 1:
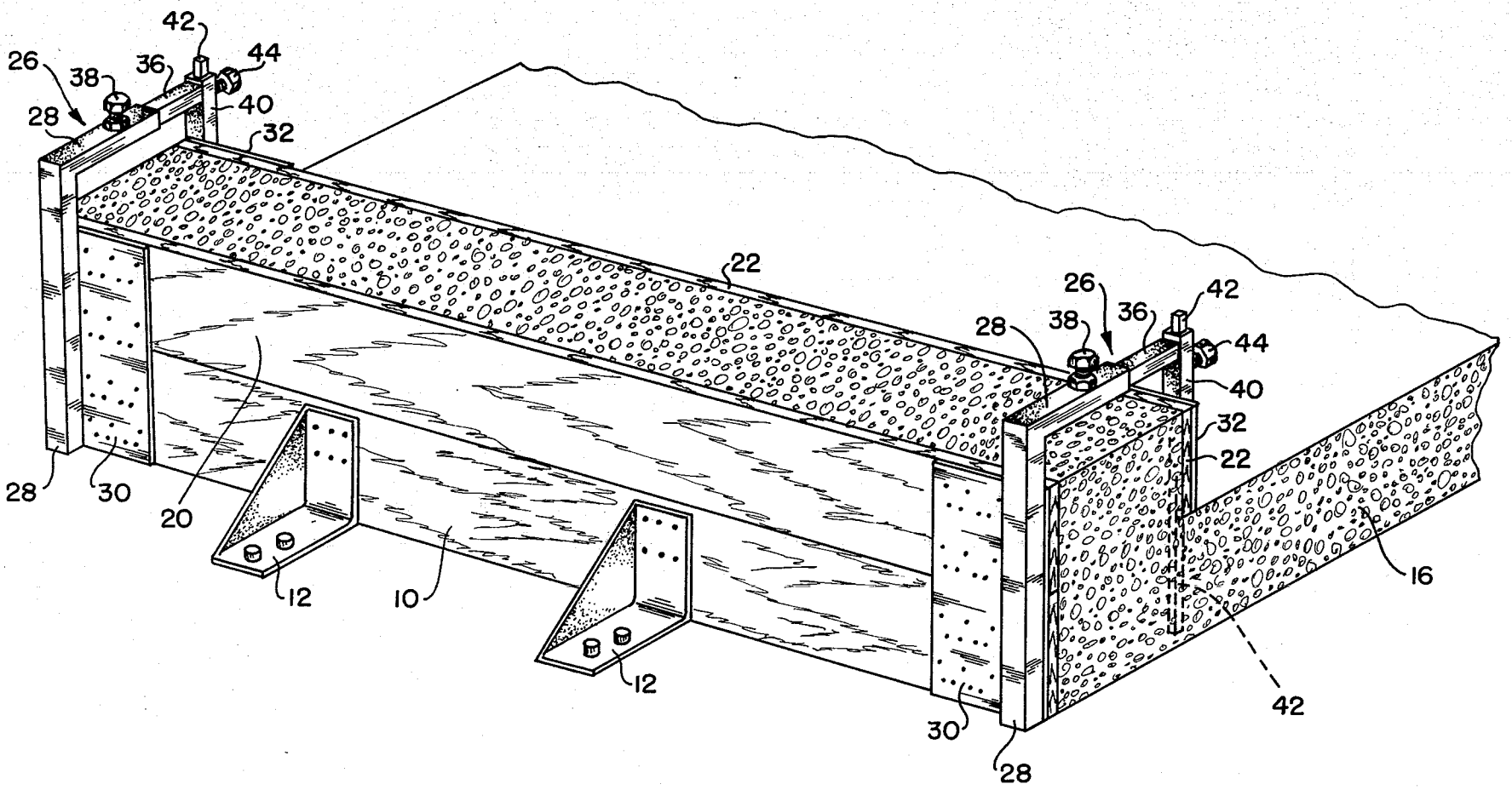
FIG. 1 is a perspective representation of a wooden form and bracing brackets, by which a concrete panel and an integral concrete column may be poured together, with the column positioned at one end of the panel.

In the representation of FIG. 1, a wooden form member 10 is shown, supported by two brackets 12, with the bracket being of the type disclosed in the aforementioned copending application. The form member 10 is part of a complete rectangular form (not shown) which circumscribes a rectangular area on a horizontal base (not shown), on which concrete is poured to form a tilt-up concrete panel. As mentioned above, it is the practice to spread grease, or other appropriate material over the top surface of the base to permit the concrete panel to be tilted up from the base after it has set.

The bracket assembly of the present invention permits a concrete column to be poured at the same time the panel is being poured, the column, in the assembly of FIG. 1 being located at one end of the panel. In the representation of FIG. 1, the column is designated 14, and the concrete panel is designated 16.

In order to enable the column 14 to be poured together with the pouring of the panel 16, two additional wooden form members 20 and 22 are provided, and these form members are supported in a position, so that the form member 20 is positioned on top of the form member 10, and the form member 22 is positioned to be spaced and parallel to form member 20, and with its lower edge in the plane of the upper edge of the form.

Figure 2:
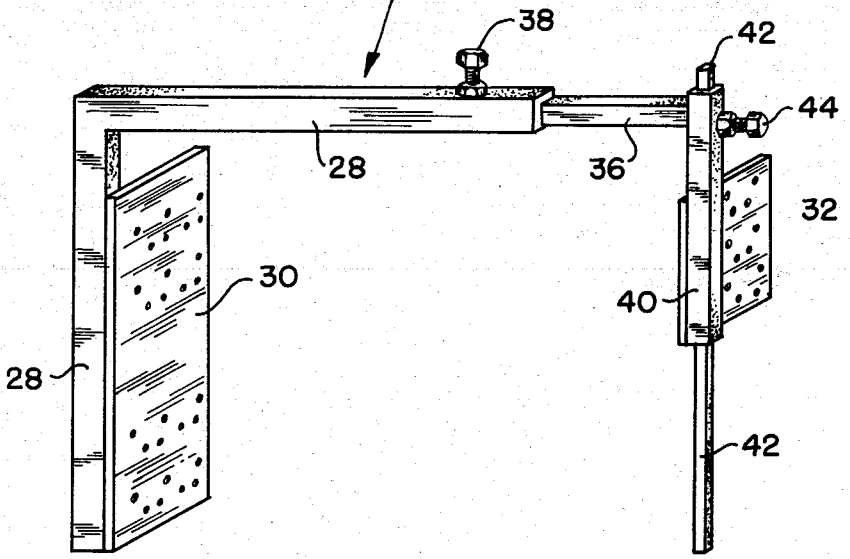
FIG. 2 is a perspective representation of one of the brackets shown in FIG. 1, and constituting one embodiment of the invention.

The form members 20 and 22 are braced by bracket assemblies 26, each of which may be constructed in accordance with one embodiment of the invention, as shown in FIG. 2.

The bracket assembly 26 includes a tubular member 28 which extends horizontally, and which supports a pair of heavy plates 30 and 32, which may be composed of steel, or other appropriate material. The plate 30 extends down to the base on which the concrete panel 16 is to be formed, and it includes holes which enables the plate to be attached to the wooden form member 10 and to the wooden form member 20. The plate 32, on the other hand, extends only to the top of the rectangular form and has holes which permit it to be attached to the form member 22.

The tubular member 28 receives a rod 36 in telescoping relationship, and the spacing between plates 30 and 32 can be adjusted to provide a desired width for column 14. When the desired spacing has been reached between the plates, they may be locked in that position by tightening a set screw 38 which extends through tubular member 28 into engagement with rod 36.

A vertical tubular member 40 is supported by rod 36 adjacent to plate 32, and a vertical rod 42 is telescopically received in tubular member 40. The rod 40 may be moved up and down in tubular member 46 to a desired position in which the rod extends down to the top surface of the base. The rod may be set in that position by tightening a set screw 44 which extends through tubular member 40 into engagement with the rod 42.

The purpose of rod 42 is to hold the forms 20 and 22 in an upright position while the concrete is being poured into the rectangular form and between the form members 20 and 22. After the concrete has been poured, and panel 16 and column have started to set, the set screw 44 may be loosened, and rod 42 pulled up through the tubular member 40 and removed. The partially set concrete of panel 16 then serves to support the forms 20 and 22 in their upright position. The hole in the partially set concrete panel 16 which occurs after the rod 42 has been removed, may be filled with concrete.

Then, the concrete column 14 and panel 16 are allowed to set completely, after which the form members 10, 20 and 22, the bracket assemblies 26, and the brackets 12 are removed. The brackets and bracket assemblies are then detached from the wooden form members, to permit the reuse of the brackets and bracket assemblies in a subsequent operation.

Figure 3:
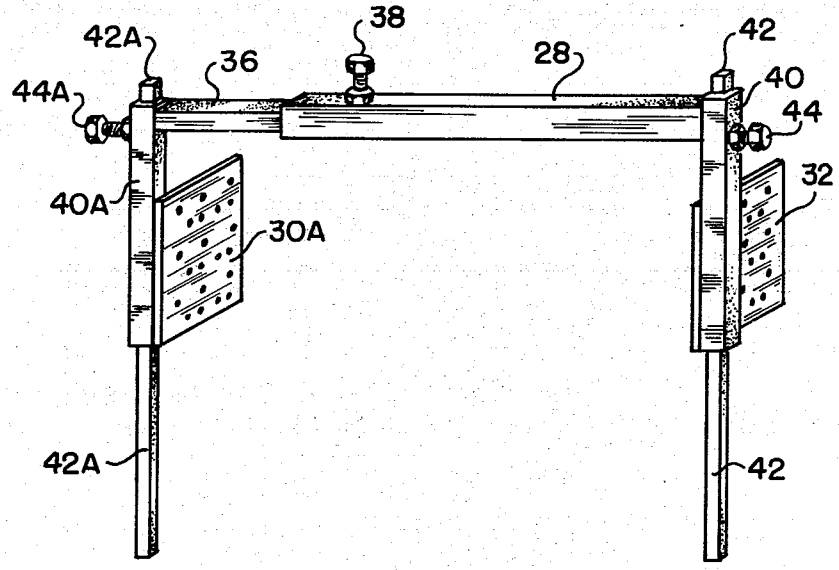
FIG. 3 is a perspective representation of a bracket constituting a second embodiment of the invention.

The bracket assembly of FIG. 3 is generally similar to that of FIG. 2, and like elements have been designated by the same numbers. However, in the embodiment of FIG. 3, the plate 30 is replaced by a plate 30A which is similar in size and shape to plate 44, and a further vertical tubular member 40A is mounted adjacent to plate 30A, which slidably receives a vertical rod 42A, with the rod being tightened to a desired position by a set screw 44A.

The bracket assembly of FIG. 3 may be used when the column 14 is to be formed to extend across an intermediate position on the panel 16, with the plates 30A and 32 being respectively secured to the wooden form members 20 and 22, and the bracket assembly serving to hold the brace the form members in an upright position across the slab.

It will be appreciated that several bracket assemblies of the type shown in FIG. 3 are normally used to brace each of the form members. In each case, the rods 42 and 42A serve to hold the bracket assembly and the forms 20 and 22 in an upright position over the panel 16, until the concrete of panel 16 begins to set. When that occurs, the rods 42 and 42A are removed, and the column 14 and panel 16 are permitted to achieve a final set. Then, as before, the form and bracket assemblies of FIG. 3 are removed, and the bracket assemblies are detached from the form and may be reused.

The invention provides, therefore, improved reusable bracket assemblies which greatly simplify the process of pouring integral columns on tilt-up concrete panels, and which expedites the overall process, and reduces the number of workers required.

It will be appreciated that while particular embodiments of the invention have been shown and described, modifications may be made, and it is intended in the claims to cover such modifications which come within the true spirit and scope of the invention.

What is claimed is:

1. A bracket assembly for supporting and bracing a pair of spaced and parallel wooden form members during the pouring of a concrete tilt-up panel on a horizontal base, a bracket assembly including: a first plate and a second plate adapted respectively to be affixed to the wooden form members; a U-shaped support bracket for supporting the first and second plates in upright vertical positions spaced and parallel from one another, said U-shaped supporting bracket including a horizontally disposed elongated member and first and second vertically disposed elongated members mounted at opposite ends of said horizontally disposed elongated member, said first vertically disposed elongated member being inextensible and being long enough to engage said horizontal base and to hold said horizontally disposed elongated member above said base, said second vertically disposed elongated member having a first portion substantially shorter than said first vertically disposed elongated member, said first plate being attached to said first vertically disposed elongated member and said second plate being attached to said first portion of said second vertically disposed elongated member, and said second vertically disposed elongated member having a second portion extensible to said base.

2. The bracket assembly defined in claim 1, in which said horizontally disposed elongated member comprises a pair of telescopically related elongated sections for permitting the first and second plates to be moved towards and away from one another to a selected spacing with respect to one another, and set screw means extending between the elongated sections for locking the plates with a selected spacing.

3. The bracket assembly defined in claim 1, in which the first portion of said second vertically disposed elongated member is tubular, and said second portion of said second vertically disposed elongated member has the form of a rod slidably received in said first portion in a telescopic relationship, and set screw means extending through said first portion into engagement with said second portion to lock said second portion in a position in which said second portion extends down to said base so as to hold the bracket assembly in an upright position with the lower edge of the second plate displaced up from the top surface of the base, and with the lower edge of the first plate adjacent to said base.

* * * * *